United States Patent [19]

Matsushita

[11] Patent Number: 4,509,026

[45] Date of Patent: Apr. 2, 1985

[54] POLARIZED ELECTROMAGNETIC RELAY

[75] Inventor: Hidetoshi Matsushita, Osaka, Japan

[73] Assignees: Matsushita Electric Works, Ltd., Osaka, Japan; SDS, Elektro GmbH, Munich, Fed. Rep. of Germany

[21] Appl. No.: 459,873

[22] PCT Filed: Apr. 30, 1982

[86] PCT No.: PCT/JP82/00147

§ 371 Date: Dec. 29, 1982

§ 102(e) Date: Dec. 29, 1982

[87] PCT Pub. No.: WO82/03944

PCT Pub. Date: Nov. 11, 1982

[30] Foreign Application Priority Data

Apr. 30, 1981 [JP] Japan ..... 56-65601
Apr. 30, 1981 [JP] Japan ..... 56-65602

[51] Int. Cl.[3] ..... H01H 51/22

[52] U.S. Cl. ..... 335/85; 335/78; 335/132

[58] Field of Search ..... 335/78, 79, 80, 81, 335/234, 265, 130, 131, 147, 148, 85, 84

[56] References Cited

U.S. PATENT DOCUMENTS

| | | | |
|---|---|---|---|
| 2,991,799 | 7/1961 | Littlefield | 335/265 |
| 3,022,400 | 2/1962 | Ahlefeldt | 335/81 |
| 3,087,031 | 4/1963 | Spinelli et al. | 335/131 |
| 3,178,534 | 4/1965 | Bundy et al. | 335/131 |
| 3,634,735 | 1/1972 | Komatsu | 361/194 |
| 4,191,937 | 3/1980 | Koehler et al. | 335/79 |

FOREIGN PATENT DOCUMENTS

| | | |
|---|---|---|
| 2535994 | 2/1977 | Fed. Rep. of Germany . |
| 56-36830 | 4/1981 | Japan . |
| 56-36109 | 4/1981 | Japan . |

*Primary Examiner*—Harold Broome
*Assistant Examiner*—George Andrews
*Attorney, Agent, or Firm*—Burns, Doane, Swecker & Mathis

[57] ABSTRACT

A polarized electromagnetic relay of this invention comprises a yoke providing air gaps at four diagonal positions and an H-shaped armature block having four pole contacting portions positioned in the air gaps of the yoke. This yoke comprises two yoke units, each of which is formed with a substantially U-shaped first magnetic member and a permanent magnet installed at one of its poles to the middle on the lower side of the first magnetic member, and a second magnetic member contacted with the other pole of the permanent magnet and providing air gaps between its both ends and the free ends of the first magnetic member. The polarized electromagnetic relay according to this invention is high in the operating speed and sensitivity and low in the impact generation, for reasons that the armature block forming a moving part is light in weight because it contains no permanent magnet therein, the magnetic efficiency is high since no permanent magnet is interposed in the path of the magnetic flux of electromagnet coil, and so on.

7 Claims, 13 Drawing Figures

51
53
53
56
56
54
53
56
27
55
23
27
27
25
30
30
50
30
55
26
30
30
31
46
39a
35
49
32
30
39
35
34
37
38
42
1
3
48
36
37
36
37
37
44
44
4
24
22
43
5
45
21
19
9
11
41
2
6
22
20
15
20
40
17
5
3
6
18
20
7
14
14
14
4
8
2
1
45
47
14
12
13

POLARIZED ELECTROMAGNETIC RELAY

TECHNICAL FIELD

The present invention relates to so-called polarized relays wherein a permanent magnet is placed in a magnetic circuit composed of an armature and yoke, the armature being moved by superposing the magnetomotive force of a coil on the magnetic flux of said permanent magnet and, particularly, to a polarized relay of the type adapted to move the armature horizontally back and forth.

BACKGROUND ART

Ordinary polarized relays have such structure that the center of the armature is pivotally supported so that the armature swings into contact with two contact pole surfaces of the yoke at diagonal positions.

Polarized relays of such structure have a problem that, unless three points at diagonally pole contacting surfaces and central pivot of the armature are maintained in dimensionally accurate relationship, there arises a phenomenon that only one of the pole contacting surfaces will achieve the contact and this will cause a beat to occur.

Thus, it has already been proposed to solve this problem by employing a structure in which the armature is moved horizontally back and forth.

For example, Japanese Patent Publication No. 41005/1980 (hereinafter referred to as the first prior art) has been proposed.

Referring to this with reference to FIG. 12, an E-shaped yoke 101 is formed with an upper piece 102, middle piece 103 and lower piece 104, a coil 105 is installed on the middle piece 103, and a permanent magnet 106 serving as an armature common to the upper, middle and lower pieces 102, 103 and 104 is opposed thereto, in which the magnetic flux of the permanent magnet 106 is in the direction indicated by X and that of the coil 105 is in the direction indicated by Y.

Therefore, the magnetic flux directions X and Y in gaps between the respective pieces 102, 103, 104 and the permanent magnet 106 are opposite to each other, that is, a repellent takes place and the permanent magnet 106 serving as the armature is moved horizontally in the direction of arrow Z.

When a coil current is subsequently made to flow so that the magnetic flux of the coil 105 will be in the opposite direction, this magnetic flux will be in the same direction as that X of the permanent magnet 106 and superposed on the latter, whereby the permanent magnet 106 being the armature is attracted.

In this polarized relay according to the first prior art, the magnetic flux induced by the coil 105 is made to pass through the permanent magnet 106, and there arises such problem that, since the permanent magnet 106 has a magnetic reluctance of about 10,000 times as high as that of ordinary yokes (iron) and involves a high percentage of loss in the magnetic flux induced by the coil 105, it is difficult to improve the sensitivity of the device.

To solve the problem described above, a polarized relay having such a structure as shown in French Pat. No. 2358006 (hereinafter referred to as the second prior art) has been further suggested.

This suggestion utilizes an advantage in the high sensitivity brought about by an arrangement in which the magnetic flux induced by the coil does not pass through the permanent magnet.

Referring thereto with reference to FIG. 13, two vertical magnetic pieces 202 and 203 and core 210*a* constitute a U-shaped yoke 201, while a permanent magnet 207, first magnetic piece 205 contacted with one pole of the permanent magnet and second magnetic piece 206 contacted with the other pole of the permanent magnet constitute an armature block 204, and the first magnetic piece 205 is formed in a U-shape having both end vertical pieces 208 and 209 opposed to the outer side surfaces of the vertical pieces 202 and 203 of the U-shaped yoke 201. The second magnetic piece 206 is opposed to the inner side surfaces of the vertical pieces 202 and 203 of the U-shaped yoke 201, and the permanent magnet 207 is held between the first and second magnetic pieces 205 and 206. A coil 210 is installed on the U-shaped yoke 201.

In this case of the second prior art, the magnetic flux X of the permanent magnet 207 flows through two magnetic paths from one pole of the permanent magnet 207 through the respective first and second magnetic pieces 205 and 206 of the armature bock 204 and back to the other pole of the permanent magnet 207 and through another magnetic path from the one pole of the permanent magnet 207 through the second magnetic piece 206 of the armature block 204, U-shaped yoke 201 and first magnetic piece 205 of the armature block 204 back to the other pole of the permanent magnet 207, while the magnetic flux of the coil 201 flows through a magnetic path through the core 210*a*, right-hand vertical piece 203 of the U-shaped yoke 201 (or the left-hand vertical piece 202 in the case when the armature block is reversed), first magnetic piece 205 of the armature block, permanent magnet 207, second magnetic piece 206 and left-hand vertical piece 202 of the U-shaped yoke 201 (or the left-hand vertical piece 203 when the armature block is reversed).

Therefore, when the directions X and Y of the magnetic fluxes in the gaps between the respective magnetic poles of the armature bock 204 and U-shaped yoke 201 are opposite to each other, a repellent takes place and, when the directions are the same, an attraction occurs, so that the armature block 204 will move horizontally in either direction depending upon the direction of the current flowing through the coil 210.

In this second prior art, the magnetic flux Y of the coil 210 does not flow through the permanent magnet 207 and the problem in the first prior art is solved.

However, the second prior art has another problem owing to the employment of the structure in which the permanent magnet is included in the armature block.

That is, because of the presence of the permanent magnet in the armature block, the operating speed of the armature block is slower by an amount corresponding to the weight of the permanent magnet 207, and eventual enlargement of the block results in a higher impact force and in a promotion of vibrations. Further, because of the gravity, the characteristics become unbalanced depending upon the direction in which the block is installed.

Another problem in the second prior art resides in that, as the yoke 201 is present only in the upper region of the armature block 204 and a spatial allowance is required to be present above and below the block with respect to guide means for its horizontal reciprocations, the block is pulled toward the yoke by an amount corresponding to such allowance at all times.

Therefore, the orientation of the yoke 201 changes depending upon the state in which the installation is made and, because of the weight of the armature block 204, the characteristics become also unbalanced as in the above.

Yet, any manner in which the horizontal reciprocation of the armature is practically realized in the polarized relay still has not been suggested and such realization should not be easy.

As a third prior art, there exists, for example, U.S. Pat. No. 2,794,882 but this is of a so-called non-polarized relay having no permanent magnet installed therein.

DISCLOSURE OF THE INVENTION

The present invention is to solve the various problems in these conventional polarized relays and to provide a polarized relay which is advantageous in its manufacture and applications. According to the present invention, a permanent magnet is interposed between first and second yokes, these first and second yokes and permanent magnet are joined into one block, two of which are disposed to oppose each other vertically above and below, and a horizontally moving type armature is formed with two lateral pieces moved into and out of contact with contacting pole surfaces of the first and second yokes in the opposing blocks and with a horizontal bar connecting the lateral pieces as extended through a coil, whereby it is made possible to utilize the advantage of the horizontally moving type armature and to achieve a novel development.

Another object of the present invention is to reduce any loss factor for the magnetic flux induced by the coil and increase the sensitivity by not allowing the magnetic flux of the coil to pass through the permanent magnets.

A further object of the present invention is to minimize the mass of the armature by installing no permanent magnet thereon and to increase the operating speed of the armature.

Still another object of ther present invention is to maintain the balance and prevent any fluctuation in the operating characteristics due to the direction of installation by arranging the yoke and permanent magnet above and below the armature with the latter as the center.

Yet another object of the present invention is to realize a polarized relay of the type in which the armature is horizontally moved.

Figure 1:
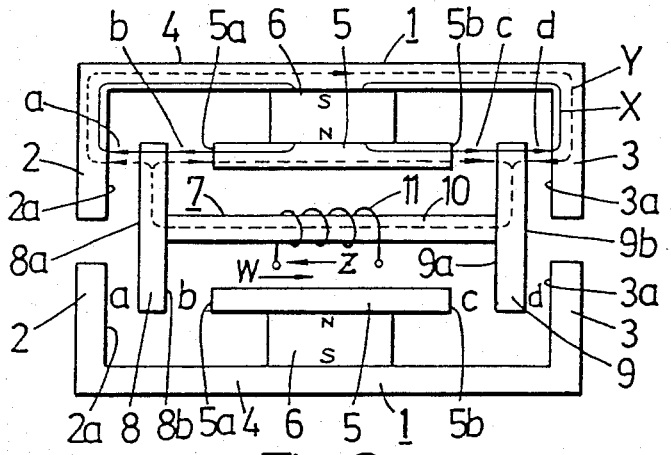
FIG. 1 is a diagram showing the basic principle for working the polarized relay.

In this polarized relay, as seen in FIGS. 1 through 11, a first yoke 1 is formed into a U-shape wit two lateral pieces 2 and 3 and longitudinal or horizontal piece 4 connecting these lateral pieces 2 and 3, in which the inner opposing surfaces of the lateral pieces 2 and 3 form contacting pole surfaces *2a* and *3a*. A second yoke 5 is shorter than the distance between the lateral pieces 2 and 3 of the first yoke 1 and is opposed to the horizontal piece 4. The outer side surfaces of the second yoke 5 are made to be contacting pole surfaces *5a* and *5b*. A permanent magnet 6 is interposed between the first and second yokes 1 and 2 and the direction of its magnetization axis is made vertical. The first and second yokes 1 and 5 and permanent magnet 6 are made to be one block and two of them are disposed vertically above and below. An armature 7 is made to be the horizontally moving type of an H-shape formed of two lateral pieces 8 and 9 and a longitudinal piece in the form of a horizontal bar 10 connecting these lateral pieces 8 and 9, in which the inner and outer surfaces of the lateral pieces 8 and 9 are made to be pole contacting surfaces *8a, 8b, 9a, 9b,* which are opposed to the inner and outer contacting pole surfaces *2a, 3a, 5a, 5b* of the first and second yokes 1 and 5, defining air gaps a, b, c, d, respectively. The horizontal bar 10 of the armature 7 extends through a coil 11.

Thus, the magnetic circuits of the permanent magnet 6 and coil 11 are as shown in FIG. 1, which illustrates the basic principle, wherein solid lines X indicate the magnetic flux of the permanent magnet 6 and dotted lines Y are of the magnetic flux induced by the coil 11.

In FIG. 1, the magnetic flux X of the permanent magnet 6 flows as follows:

N pole of permanent magnet 6→second yoke 5→air gaps b and c→lateral pieces 8, 9 of armature 7→air gaps a, d→lateral pieces 2, 3 of first yoke 1→horizontal piece 4 S pole.

The magnetic flux Y of the coil 11 flows as follows:

Coil 11→horizontal bar 10 of armature 7→left-hand lateral piece 8→air gap a→left-hand lateral piece 2 of first yoke 1→horizontal piece 4→right-hand lateral piece 3→air gap d→right-hand lateral piece 9 of armature 7→horizontal bar 10.

There is another flow from the left-hand lateral piece 8 of armature 7→air gap b→second yoke 5→air gap c→right-hand lateral piece 9 of armature 7→horizontal bar 10.

An observation of the air gaps a, b, c, d will show that directions of the magnetic fluxes X and Y of the permanent magnet 6 and coil 11 are identical at the air gaps a and c but are opposite at the air gaps b and d.

Therefore, in the first and second yokes 1, 5 and armature 7, there arise an attractive force with the magnetic fluxes X and Y superposed on each other when in the same direction whereas a repellent takes place with the fluxes cancelling each other when they are in opposite directions so that, in FIG. 1, the armature 7 horizontally travels to the left as indicated by the arrow Z until the outer pole contacting surface 8*a* of the left-hand lateral piece 8 of the armature 7 contacts the inner contacting pole surfaces 2*a* of the right-hand lateral pieces 2 of the first yokes 1 and the inner pole contacting surface 9*a* of the right-hand lateral piece 9 of the armature 7 contacts the outer contacting pole surfaces 5*b* of the second yokes 5.

This attracted state is maintained by the magnetic fluxes of the permanent magnets 6 even if the current flowing through the coil 11 is cut off.

When it is desired to move the armature 7 horizontally to the right in contrast to the above, a current opposite in direction to the above is passed through the coil 11 to cause the magnetic flux Y induced in a manner reverse to FIG. 1.

The directions of the magnetic fluxes in the air gaps a, b, c, d are reversed to be opposite at the gaps a and c and identical at the gaps b and d, so that the armature 7 will horizontally move to the right as indicated by the arrow W.

The attracted state is maintained also by the magnetic fluxes of the permanent magnets 6, as in the above case.

In view of the above, the magnetic flux Y of thecoil 11 is not allowed to pass through the permanent magnets 6 of which the magnetic reluctance is high and a high sensitivity is achieved. The armature 7 to which the coil 11 and permanent magnets 6 are not fixed performs its own operation, and its mass is made to be the minimum.

The arrangement shown in FIGS. 2 through 5 is an embodiment of the basic principle illustrated in FIG. 1.

The upper and lower first yokes 1 are housed in a top-opened box 12 of a synthetic resin.

Figure 2:
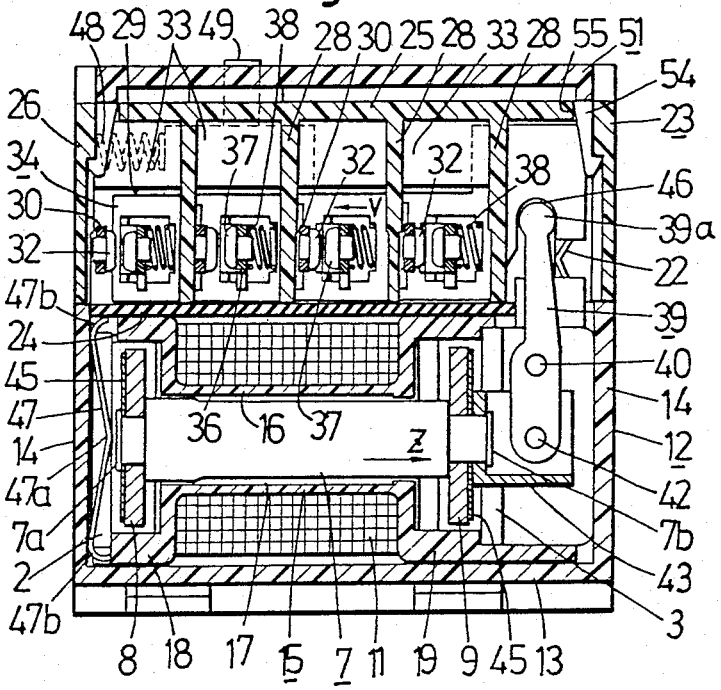
FIG. 2 is a sectional view showing an application of the basic principle in FIG. 1 to a horizontally movable contact block.
Figure 3:
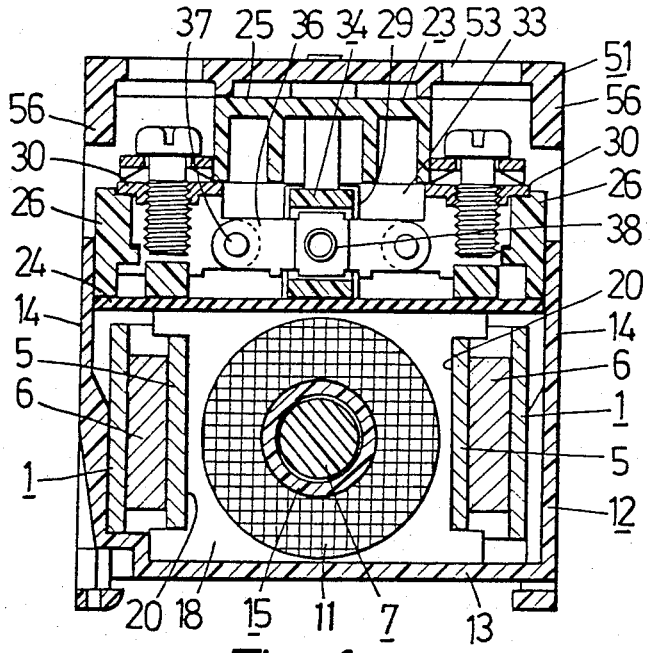
FIG. 3 is a side elevation, in section, of the device of FIG. 2.
Figure 4:
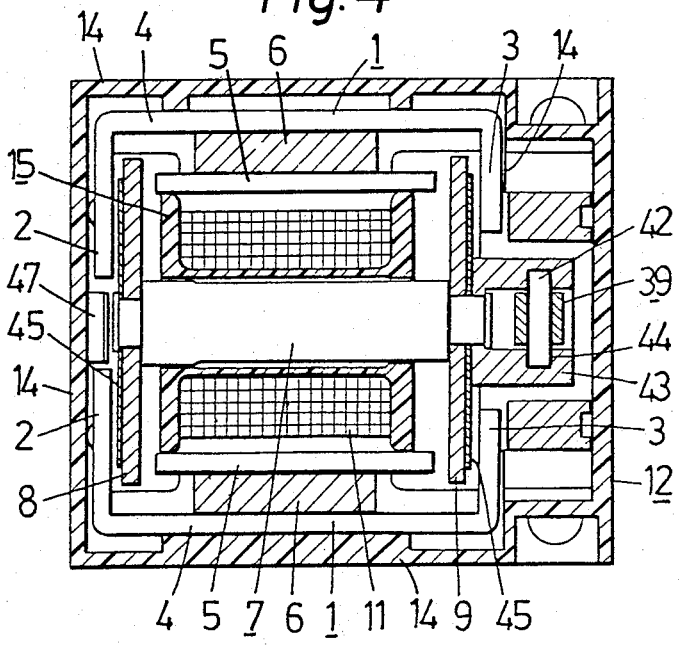
FIG. 4 is a plan view, in section, of the device of FIG. 2.
Figure 5:
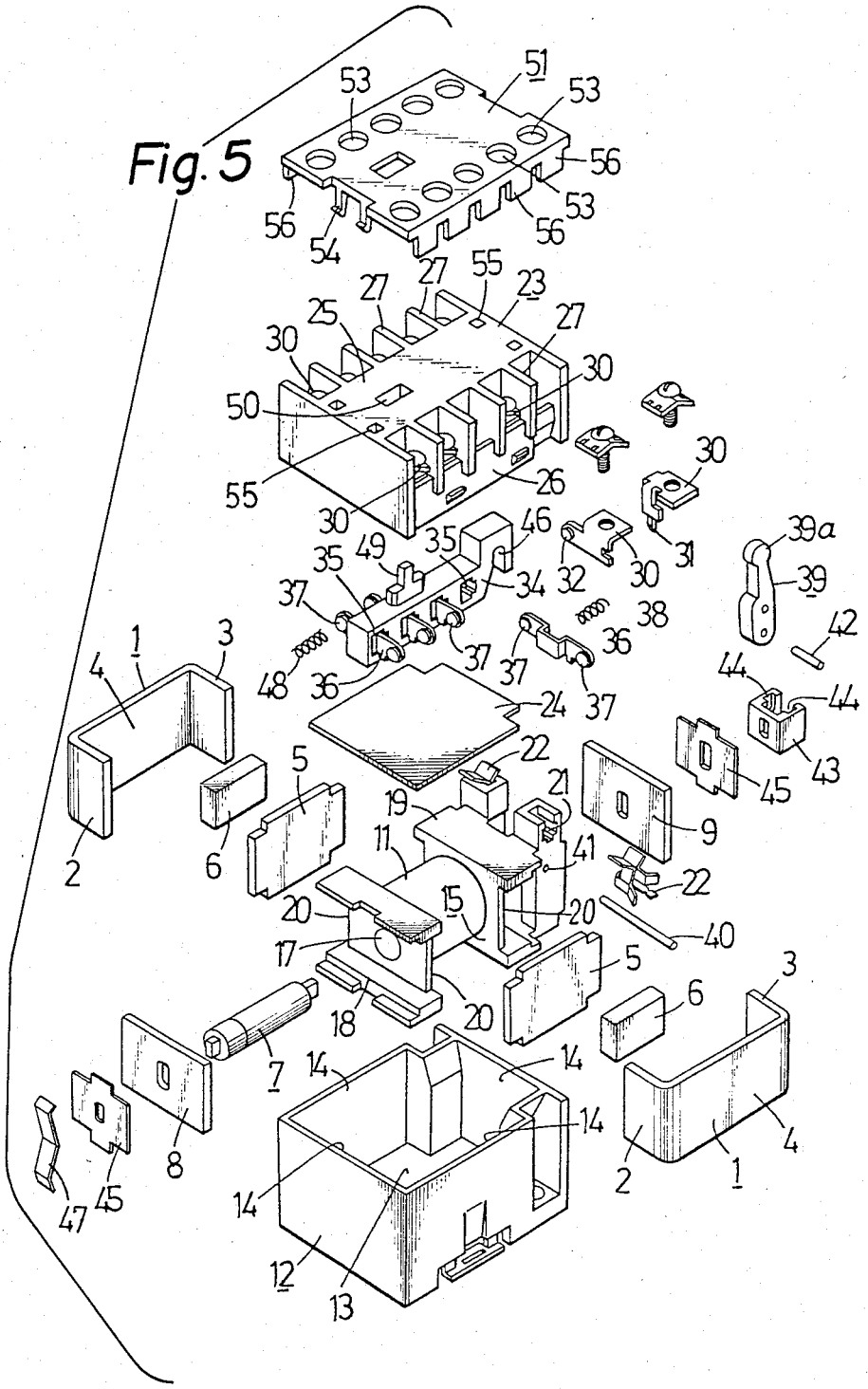
FIG. 5 is a perspective view as disassembled of the device of FIG. 2.

In this case, the upper and lower first yokes 1 are seated on the bottom wall 13 of the box 12 in a state where they are turned in FIG. 2 through 90 degrees from that in FIG. 1, with their respective lateral pieces 2 and 3 and horizontal pieces 4 contacted with four side walls 14 of the box.

A bobbin 15 for the coil 11 is constructed as follows:

The coil 11 is wound on a drum portion 16 having a hole 17 through which the armature 7 extends, the drum portion 16 has integrally formed both side walls 18 and 19 between which the upper and lower second yokes 2 turned through 90 degrees from the state of FIG. 1 are fixed in parallel with the coil 11. These lateral walls 18 and 19 are provided with notches 20 for easily engaging and fixing the second yokes 5 thereto. The right-hand side wall 19 is provided with grooves 21 for engaging therein support edge terminals 22.

A cover 23 made of a synthetic resin is fitted over the top opening of the box 12. An insulation plate 24 is interposed between the cover 23 and the box 12.

The cover 23 is constructed as follows:

The cover 23 comprises a top wall 25, side walls 26 including lowered opposing walls, outer separators 27 connecting the top wall 25 to the lowered side walls 26 and dividing them into a plurality of sections, inner separators 28 aligned with the outer separators 27, and a downwardly opened cavity 29 crossing the inner separators 28.

Outer terminals 30 are fixed in opposite outer chambers defined by the lowered opposing side walls 26 and the outer separators 27 of the cover 23. The terminals 30 at the right-hand extremity on the both sides have integrally formed vertical insert edges 31 to be inserted in the support edge terminals 22 of the coil bobbin 15 to complete electric connection to the coil 11 when the cover 23 and box 12 are assembled together. The other terminals 30 are provided with fixed contacts 32 positioned in opposing inner chambers 33 defined by the inner separators 28.

An movable block 34 made of a synthetic resin and moved in parallel with the armature 7 is positioned in the downwardly opened cavity 29 of the cover 23.

The movable block 34 is formed to have transverse through holes 35 at positions corresponding to the inner chambers 33 of the cover 23, in which holes there are installed contact plates 36 carrying contacts 37 projected out of the holes to both sides and coil springs 38 for providing contact pressure. These contacts 37 and 32 respectively of the movable block and cover 23 are opposed to each other in the inner chambers 33 to be engaged with and separated from each other as the movable block 34 is moved.

The movable block 34 is prevented from moving out of its position by means of the insulation plate 24.

Connection between the movable block 34 and the armature 7 is effected by a reversing lever 39.

The reversing lever 39 receives a shaft 40 in the middle thereof, and this shaft 40 is supported in shaft-receiving holes 41 in the right-hand side wall 19 of the coil bobbin 15.

Referring to the relationship between the reversing lever 39 and the armature 7, a shaft 42 is passed through the lower end of the lever, the shaft 42 is fitted in a groove 44 in a connector 43 from above, and the right-hand end of the armature 7 is inserted in the connector 43 and caulked to form a slip-off preventing portion 7*b*.

In the similar manner, the left-hand end of the armature 7 is also inserted in the left-hand side piece 8 and caulked to form a slip-off preventing portion 7*a*, at the same time with which a nonmagnetic plate 45 is interposed at the both ends. These plates 45 are provided in order to cut off opposite ends of the magnetic characteristic curve of the permanent magnets 6 so that the latter may be used in the most stable region of the curve.

In the relationship between the reversing lever 39 and the movable block 34, the upper end 39*a* of the lever is engaged in a downwardly opened notch 46 of the block.

When, therefore, the armature 7 is moved horizontally to the right as indicated by the arrow Z, the reversing lever 39 is turned counterclockwise with its middle shaft 40 as the center, the movable block 34 is moved horizontally to the left as indicated by the arrow V, opposite to the armature, and the contacts 32 and 37 in the respective chambers are engaged with each other. This engagement is maintained by the magnetic fluxes of the permanent magnets 6 due to the principle illustrated in FIG. 1.

The armature 7 is resiliently urged in the direction of arrow Z by an angled plate spring 47, which abutting at its apex 47*a* against the left-hand slip-off preventing portion 7*a* and at its both ends 47*b* against the left-hand side wall 14 of the box 12.

The movable block 34 is resiliently urged by a coil spring 48 in a direction opposite to that of the arrow V. The coil spring 48 is positioned between an indicator post 49 on the movable block 34 and the left-hand side wall 26 of the cover 23.

The spring pressures of these two springs 47 and 48 act mutually in opposite directions with respect to the armature 7 and movable block 34, whereby the separation of the armature 7 as moved away from the state of being attracted by the magnetic fluxes of the permanent magnets 6 is facilitated.

The indicator post 49 on the movable block 37 porject upward through a small hole 50 in the top wall 25 of the cover 23 and its position enables the internal operation to be ascertained from outside.

A terminal cover 51 is fitted over the top wall 25 of the cover 23. Screwdriver-operating holes 53 corresponding in number to the terminals 30 on both sides are present in the terminal cover 51.

For mounting purposes of the terminal cover 51, hooking legs 54 are provided on its both sides, which are inserted in small holes 55 in the top wall 25 of the cover 23. The terminal cover 51 is further porvided on the other sides thereof with dependent skirts 56 each positioned between adjacent ones of the outer separators 27 of the cover 23 to render the terminals 30 to be exposed only to the least possible extent.

Figure 6:
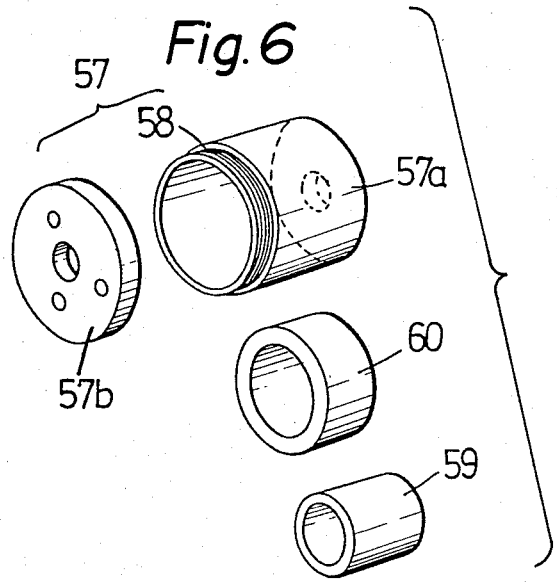
FIG. 6 is a perspective view as disassembled of another embodiment wherein the first and second yokes and permanent magnets are in cylindrical form.

References shall be made to FIG. 6;

There is shown another embodiment of the invention, not departing from the basic principle illustrated in FIG. 1. In this embodiment, the first and second yokes 1 and 5 and permanent magnets 6 which have been shown in the embodiment of FIGS. 2 through 5 as being in plate form and as being vertically separately disposed, are in cylindrical form, and the number of parts is reduced. In this case, a cylindrical first yoke 57 is divided into a cylindrical body 57*a* and an end portion or cap 57*b*, which are united together by screw threads 58. With the cap 57*b* removed, a cylindrical second yoke 59 and cylindrical permanent magnet 60 are received therein.

Figure 7:
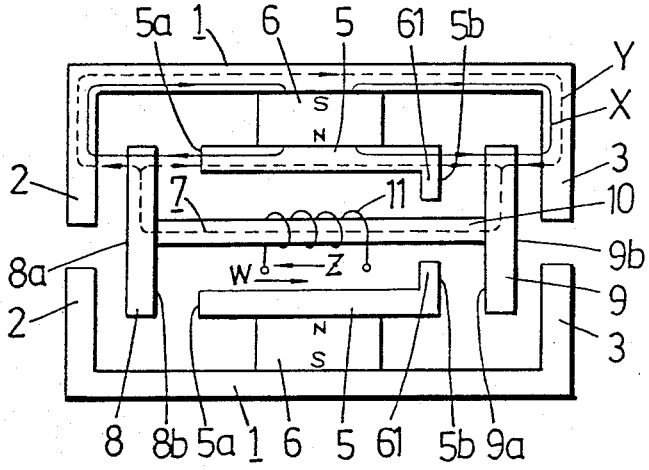
FIG. 7 is a view illustrating in the basic principle another embodiment wherein the contacting pole surfaces of the second yokes are enlarged to form the armature as a unidirectional operation type.

In the case of FIG. 7, the area of the right-hand contacting pole surfaces 5*b* of the second yokes 5 are made greater than that of the left-hand contacting pole surfaces 5*a*. This is realized by a lateral piece 61 of the yokes which intensifies the magnetic flux of the permanent magnet 6 with an increased magnetic flux density, whereby there can be provided a so-called unidirectional operation type (also referred to as the monostable type) wherein, if the current through the coil 11 is cut off when the armature 7 is moved in the direction of arrow W, the armature is caused to return in the direction of arrow Z by the intensified magnetic flux of the permanent magnet 6.

Figure 8:
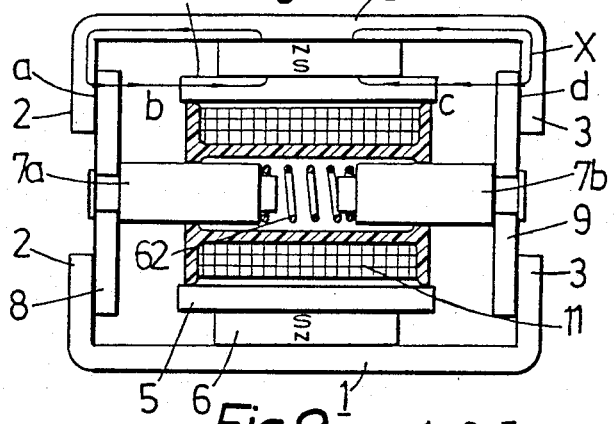
FIG. 8 is a view illustrating in the basic principle a further embodiment wherein the armature is divided at the middle into two halves to provide the tridirectional operation type.
Figure 9:
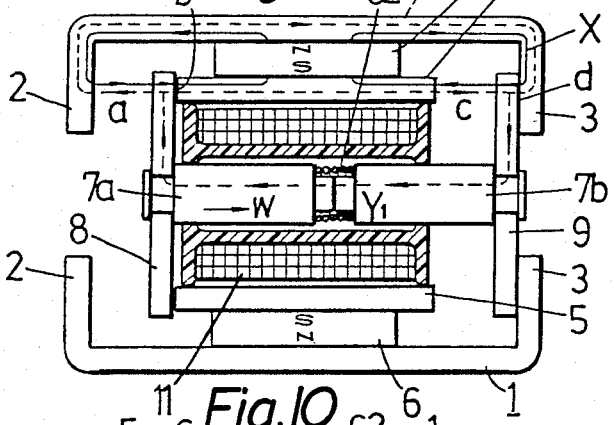
FIGS. 9 and 10 are views showing operations in directions different from that in FIG. 8.
Figure 10:
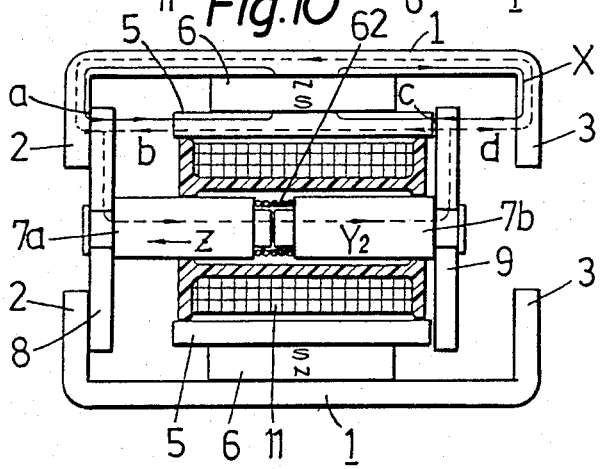

FIGS. 8 through 10 shall now be referred to:

An arrangement shown therein is of a so-called tridirectional operation type (also referred to as the triplestable type) wherein the horizontal bar 10 of the armature 7 is divided at the middle into two halves which are symmetrical with a coil spring 62 interposed between these halves 7*a* and 7*b* to resiliently outwardly urge the halves away from each other.

FIG. 8 shows a first operating state wherein the magnetic fluxes of the permanent magnets 6 alone are active, with the armature halves 7*a* and 7*b* resiliently outwardly urged away from each other by the coil spring 62, so that, in the air gaps a and d, the lateral pieces 8 and 9 of the armature 7 are attracted into contact with the lateral pieces 2 and 3 of the first yokes 1 while, in the air gaps b and c, the lateral pieces 8 and 9 of the armature 7 are spaced apart from the second yokes 5.

FIG. 9 shows a second operating state wherein, with a current flowing through the coil to cause a magnetic flux $Y_1$ in a certain direction induced, the magnetic flux $Y_1$ of the coil 11 and the magnetic fluxes X of the permanent magnets 6 are opposite in the direction at the air gaps a and c but are identical at the air gaps b and d. Therefore, as compared with FIG. 8, the left-hand armature half 7*a* alone is moved to the right as indicated by the arrow W against the force of the coil spring 62, so that the second yokes 5 and left-hand lateral piece 8 on the left-hand armature half 7*a* attract and contact with each other, while the right-hand lateral piece 9 of the right-hand armature half 7*b* remains in contact with the right-hand lateral pieces 3 of the first yokes 1. Even when the current fed to the coil 11 is interrupted, the present state is maintained by the flux X of the permanent magnet 6.

FIG. 10 shows a third operating state wherein, with a current flowing through the coil 11 to cause a magnetic flux $Y_2$ induced in the direction opposite to the one shown in FIG. 9, the magnetic flux $Y_2$ of the coil 11 and the magnetic fluxes X of the permanent magnets 6 are identical in the direction at the air gaps a and c but are opposite at the air gaps b and d. Therefore, in contrast to FIG. 9, only the right-hand armature half 7*b* is moved to the left as indicated by the arrow Z against the force of the coil spring 62, whereby the left-hand lateral pieces 2 of the first yokes 1 and the left-hand lateral piece 8 of the left-hand armature half 7*a* as well as the second yokes 5 and the right-hand side haft 7*b* attract to contact with each other. Even when the current to the coil 11 is interrupted, the existing state is maintained by means of the magnetic fluxes X of the permanent magnets 6.

Figure 11:
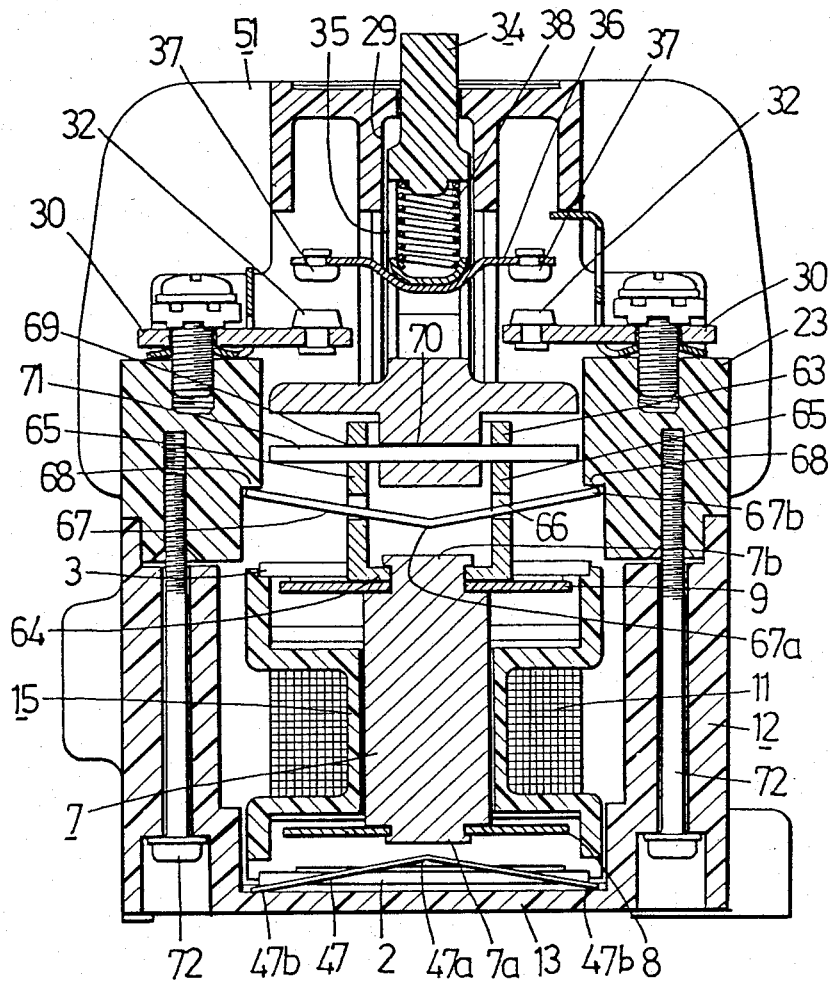
FIG. 11 is a sectional view showing the basic principle in FIG. 1 applied to an armature and movable block which are adapted to travel vertically.
Figure 12:
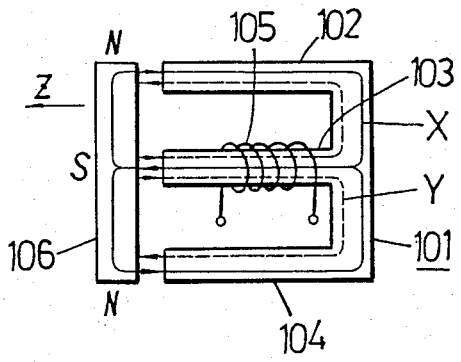
Fig. 12 PRIOR ART
FIG. 12 is a view illustrating in the basic principle the first prior art.
Figure 13:
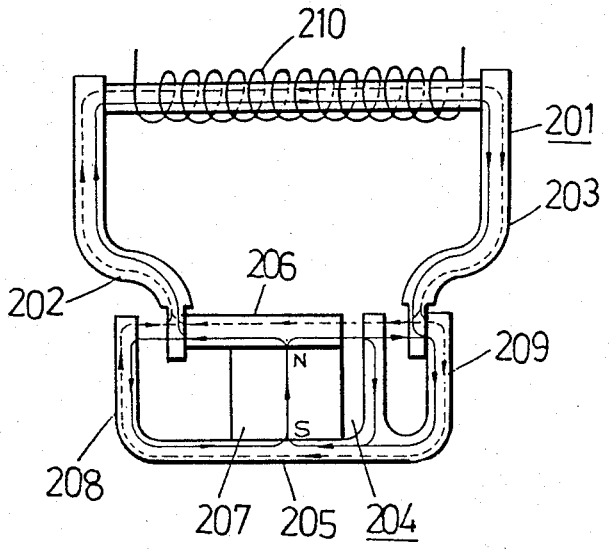
Fig. 13 PRIOR ART
FIG. 13 is a view illustrating in the basic principle the second prior art.

FIG. 11 shows a further development of the basic principle illustrated in FIG. 1.

While the armature 7 and movable block 34 in the embodiment shown in FIGS. 2 through 5 are horizontal and are vertically parallel with each other, the present embodiment disposes these armature 7 and movable block 34 vertically above and below on a common axis, the main parts of which are shown in section specifically taken in the same direction as in FIG. 2.

The angled plate spring 47 is seated on the bottom wall 13 of the box 12, and the left-hand lateral pieces 2 of the first yokes 1 are also seated thereon.

On the apex 47*a* of the angled plate spring 47, naturally, the left-hand slip-off preventing portion 7*a* of the armature 7 is placed as disposed downward. The right-hand slip-off preventing portion 7*b* of the armature 7 is thus disposed upward and coupled to a lower portion 64 of a U-shaped connector 63 having small holes 66 in both side portions 65, and a second angled plate spring 67 is fitted through the holes 66 to have its both ends 67*b* engaged to both side support steps 68 in the cover 23. This angled spring 67 provides the same action as the coil spring 48 in the embodiment of FIGS. 2 through 5 to the armature 7 and movable block 34 which is adapted to travel vertically and coaxially with the armature 7. Therefore, the lower angled plate spring 47 resiliently urges the armature 7 and movable block 34 upward while the upper angled plate spring 67 resiliently urges them downward when the contacts are open and upwards when the contacts are closed. The movable block 34 and connector 63 are connected by means of a shaft 71 inserted through shaft receiving holes 69 in the both side portions 65 of the connector 63 and through a shaft receiving hole 70 in the movable block 34. The box 12 and cover 23 are connected together by means of connecting screws 72.

Such other parts as the contacts 32, 37, terminal cover 51 and so on are the same as in the embodiment of FIGS. 2 through 5.

I claim:

1. A polarized electromagnetic relay comprising:

a U-shaped first yoke comprising right and left lateral pieces interconnected by a longitudinal piece, said lateral pieces including mutually facing inner surfaces which define contacting pole surfaces, a second yoke shorter than the distance between said right and left lateral pieces of said first yoke and disposed generally parallel to said longitudinal piece of said first yoke, said second yoke including right and left outer lateral surfaces which define contacting pole surfaces, a first permanent magnet disposed between said second yoke and said longitudinal piece of said first yoke and having a magnetization axis directed generally parallel to planes defined by said lateral and longitudinal pieces of said first yoke, a U-shaped third yoke comprising right and left lateral pieces interconnected by a longitudinal piece, said lateral pieces of said third yoke including mutually facing inner surfaces which define contacting pole surfaces, said right and left lateral pieces of said third yoke extending toward said plane defined by said longitudinal piece of said first yoke, and said right and left lateral pieces of said first yoke extending toward a plane defined by said longitudinal piece of said third yoke, a fourth yoke shorter than the distance between said right and left lateral pieces of said third yoke and disposed generally parallel to said longitudinal piece of said third yoke, said fourth yoke including right and left outer lateral surfaces which define contacting pole surfaces, a second permanent magnet disposed between said fourth yoke and said longitudinal piece of said third yoke and having a magnetization axis directed generally parallel to planes defined by said lateral and longitudinal pieces of said first yoke, an armature positioned between said second and fourth yokes and including right and left lateral pieces interconnected by a longitudinal piece, said longitudinal piece of said armature being disposed between and parallel to said second and fourth yokes, said lateral pieces of said armature each forming inner and outer contact surfaces, said armature being longitudinally reciprocable along a longitudinal axis of said longitudinal piece of said armature such that when said armature is at either end of its reciprocable stroke:

said inner contact surface of one of said lateral pieces of said armature engages adjacent contacting pole surfaces of said second and fourth yokes, and said outer contact surface of the other of said lateral pieces of said armature engages adjacent contacting pole surfaces of said first and third yokes, a coil disposed around said longitudinal piece of said armature, and said longitudinal piece of said armature comprising two separate sections, each said section carrying one of said lateral pieces of said armature, and spring means for resiliently biasing said sections away from one another to thereby resiliently bias said lateral pieces of said armature toward said lateral pieces of first and third yokes.

2. A polarized electromagnetic relay comprising:

an outer yoke including a cylindrical portion and a pair of end portions, said end portions including mutually facing inner surfaces which define contacting pole surfaces, an inner yoke including a cylindrical portion disposed within said cylindrical portion of said outer yoke, said cylindrical portion of said inner yoke having radius smaller than that of said cylindrical portion of said outer yoke and a longitudinal length shorter than the distance between said end portions of said outer yoke such that said cylindrical portion of said inner yoke is radially spaced from said cylindrical portion of said outer yoke and is longitudinally spaced from both said end portions of said outer yoke, opposite ends of said inner yoke forming contacting pole surfaces, a cylindrically shaped permanent magnet disposed radially between said cylindrical portions of said inner and outer yokes, an armature longitudinally reciprocable within said inner yoke, said armature including a longitudinal piece interconnecting right and left pieces, each of said lateral pieces each forming inner and outer contact surfaces, said armature being longitudinally reciprocable along a longitudinal axis of said longitudinal piece of said armature such that when said armature is at either end of its reciprocable stroke:

said inner contact surface of one of said lateral pieces of said armature engages one contacting pole surface of said inner yoke, and said outer contact surface of the other lateral piece of said armature engages one contacting pole surface of said outer yoke, and a coil disposed around said longitudinal piece of said armature.

3. A relay according to claim 2, wherein one of said contacting pole surfaces of said inner yoke being larger than the other contacting pole surface thereof.

4. A relay according to claim 2, wherein said longitudinal piece of said armature comprises two separate sections, each said section carrying one of said lateral pieces of said armature, and spring means for resiliently biasing said sections away from one another to thereby resiliently bias said lateral pieces of said armature toward respective end portions of said outer yoke.

5. A polarized electromagnetic relay comprising:

a U-shaped first yoke comprising right and left lateral pieces interconnected by a longitudinal piece, said lateral pieces including mutually facing inner surfaces which define contacting pole surfaces, a second yoke shorter than the distance between said right and left lateral pieces of said first yoke and disposed generally parallel to said longitudinal piece of said first yoke, said second yoke including right and left outer lateral surfaces which define contacting pole surfaces, a first permanent magnet disposed between said second yoke and said longitudinal piece of said first yoke and having a magnetization axis directed generally parallel to planes defined by said lateral and longitudinal pieces of said first yoke, a U-shaped third yoke comprising right and left lateral pieces interconnected by a longitudinal piece, said lateral pieces of said third yoke including mutually facing inner surfaces which define contacting pole surfaces, said right and left lateral pieces of said third yoke extending toward said plane defined by said longitudinal piece of said first yoke, and said right and left lateral pieces of said first yoke extending toward a plane defined by said longitudinal piece of said third yoke, a fourth yoke shorter than the distance between said right and left lateral pieces of said third yoke and disposed generally parallel to said longitudinal piece of said third yoke, said fourth yoke including right and left outer lateral surfaces which define contacting pole surfaces, a second permanent magnet disposed between said fourth yoke and said longitudinal piece of said third yoke and having a magnetization axis directed generally parallel to planes defined by said lateral and longitudinal pieces of said first yoke, an armature positioned between said second and fourth yokes and including right and left lateral pieces interconnected by a longitudinal piece, said longitudinal piece of said armature being disposed between and parallel to said second and fourth yokes, said lateral pieces of said armature each forming inner and outer contact surfaces, said armature being longitudinally reciprocable along a longitudinal axis of said longitudinal piece of said armature such that when said armature is at either end of its reciprocable stroke:

said inner contact surface of one of said lateral pieces of said armature engages adjacent contacting pole surfaces of said second and fourth yokes, and said outer contact surface of the other of said lateral pieces of said armature engages adjacent contacting pole surfaces of said first and third yokes, a coil disposed around said longitudinal piece of said armature, and a box and a cover, said box housing therein said coil, said first, second, third and fourth yokes, said first and second permanent magnets and said armature which travels horizontally with respect to a bottom wall of the box, said cover housing therein a horizontally movable block, a plurality of movable contact plates installed in said movable block and fixed contact plates engageable with said movable contact plates, and a reversing lever pivotably mounted intermediate its ends so that upper and lower ends thereof are turned in mutually opposite directions said lever extending between the box and cover, the upper end of said reversing lever being linked to said movable block, and the armature and movable block are respectively spring-biased in the same direction.

6. A relay according to claim 5, wherein the contacting pole surfaces at one pair of adjacent ends of said second and fourth yokes are larger than the contacting pole surfaces at the other pair of adjacent ends of said second and fourth yokes.

7. A polarized electromagnetic relay comprising:

a U-shaped first yoke comprising right and left lateral pieces interconnected by a longitudinal piece, said lateral pieces including mutually facing inner surfaces which define contacting pole surfaces, a second yoke shorter than the distance between said right and left lateral pieces of said first yoke and disposed generally parallel to said longitudinal piece of said first yoke, said second yoke including right and left outer lateral surfaces which define contacting pole surfaces, a first permanent magnet disposed between said second yoke and said longitudinal piece of said first yoke and having a magnetization axis directed generally parallel to planes defined by said lateral and longitudinal pieces of said first yoke, a U-shaped third yoke comprising right and left lateral pieces interconnected by a longitudinal piece, said lateral pieces of said third yoke including mutually facing inner surfaces which define contacting pole surfaces, said right and left lateral pieces of said third yoke extending toward said plane defined by said longitudinal piece of said first yoke, and said right and left lateral pieces of said first yoke extending toward a plane defined by said longitudinal piece of said third yoke, a fourth yoke shorter than the distance between said right and left lateral pieces of said third yoke and disposed generally parallel to said longitudinal piece of said third yoke, said fourth yoke including right and left outer lateral surfaces which define contacting pole surfaces, a second permanent magnet disposed between said fourth yoke and said longitudinal piece of said third yoke and having a magnetization axis directed generally parallel to planes defined by said lateral and longitudinal pieces of said first yoke, an armature positioned between said second and fourth yokes and including right and left lateral pieces interconnected by a longitudinal piece, said longitudinal piece of said armature being disposed between and parallel to said second and fourth yokes, said lateral pieces of said armature each forming inner and outer contact surfaces, said armature being longitudinally reciprocable along a longitudinal axis of said longitudinal piece of said armature such that when said armature is at either end of its reciprocable stroke:

said inner contact surface of one of said lateral pieces of said armature engages adjacent contacting pole surfaces of said second and fourth yokes, and said outer contact surface of the other of said lateral pieces of said armature engages adjacent contacting pole surfaces of said first and third yokes, and a coil disposed around said longitudinal piece of said armature, the contacting pole surfaces at one pair of adjacent ends of said second and fourth yokes are larger than the contacting pole surfaces at the other pair of adjacent ends of said second and fourth yokes.

* * * * *